United States Patent [19]

Littman

[11] 4,242,780

[45] Jan. 6, 1981

[54] HAMMER WITH CHIPPING BLADE

[76] Inventor: Erwin J. Littman, 4466 N - 600 W, LaPorte, Ind. 46350

[21] Appl. No.: 93,056

[22] Filed: Nov. 13, 1979

[51] Int. Cl.[3] ..... B23C 43/00

[52] U.S. Cl. ..... 29/81 D; 7/144; 30/164.8

[58] Field of Search ..... 7/144, 145, 143, 147, 7/146; 29/81 D, 81 R; 30/164.8; 145/29 R; 125/41

[56] References Cited

U.S. PATENT DOCUMENTS

| | | | |
|---|---|---|---|
| 209,803 | 11/1878 | Dyson | 7/147 |
| 771,419 | 10/1904 | Conover | 30/164.8 |
| 2,347,878 | 5/1944 | Brewer | 29/81 D |
| 2,814,093 | 11/1957 | Hulvey | 29/81 D |
| 3,336,647 | 8/1967 | Novotny | 7/145 |
| 3,821,824 | 7/1974 | Pilcher | 7/143 |

*Primary Examiner*—Othell M. Simpson
*Assistant Examiner*—Roscoe V. Parker
*Attorney, Agent, or Firm*—Allegretti, Newitt, Witcoff & McAndrews

[57] ABSTRACT

A chipping hammer for cleaning welds or deburring the oxidized metal about the cut from a cutting torch which comprises a handle and a head of unique configuration secured to an end of the handle. The head is secured at right angles to the axis of the handle and has a hammer head portion at one end and a toothed chipping blade at the other end. The ends of the teeth lie along a concave curve wherein the rearmost tooth extends outwardly from the blade a greater extent than does the front tooth.

7 Claims, 4 Drawing Figures

Fig. 1
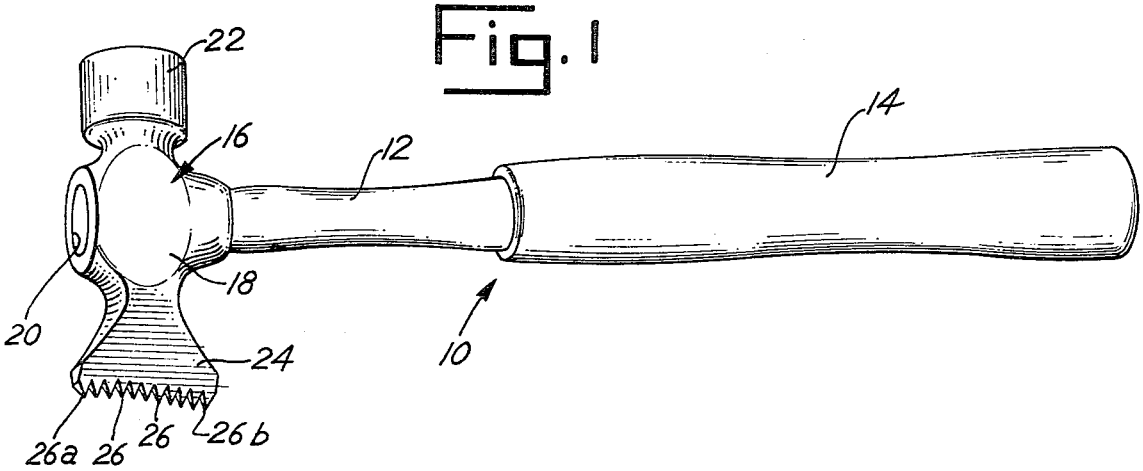
Fig. 2
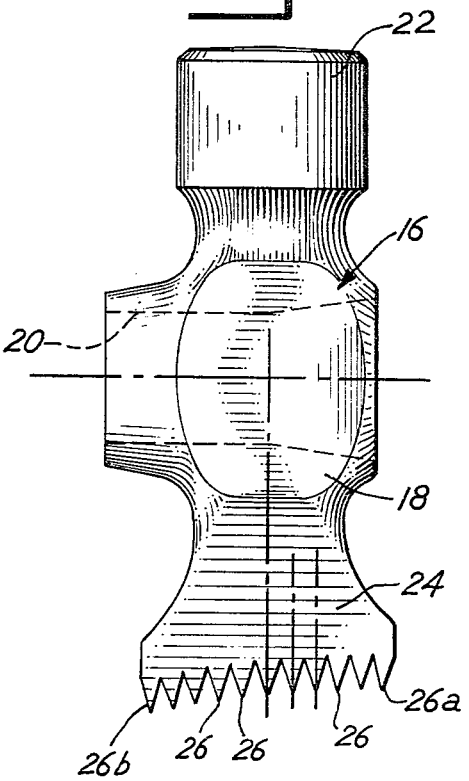
Fig. 3
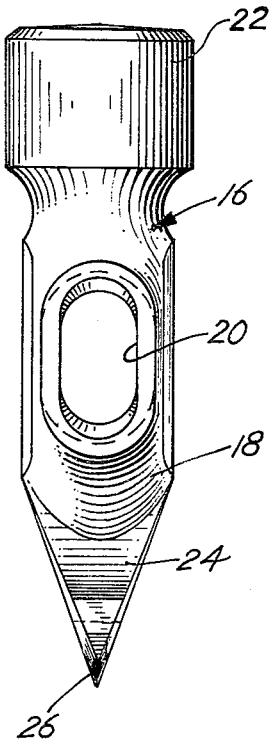
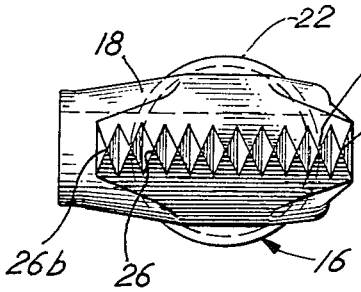
Fig. 4

HAMMER WITH CHIPPING BLADE

BACKGROUND AND SUMMARY OF THE INVENTION

This invention pertains to a chipping hammer and, more particularly, a chipping hammer for cleaning welds or deburring the oxidized metal about the cut from a cutting torch.

Hammers heretofore used by welders for chipping away the metallic scales, slag and other matter from the weld have generally comprised a handle with a head at one end. The head had a chisel-shaped blade formed integrally at one end. The Hulvey U.S. Pat. No. 2,814,093 disclosed an adjustable scaling hammer, wherein the blade was adjustable relative to the axis of the head. However, the Hulvey blade, as well as prior chipping blades, had a planar edge and did not have teeth formed thereon as in the present invention. Applicant is also aware of Dyson U.S. Pat. No. 209,803, which shows a combination tool for opening and closing cigar boxes that has some superficial resemblance to the present invention. However, the Dyson tool is not a chipping hammer for welding and the head thereof differs from that of the present invention in both structure and function.

An object of the present invention is to provide an improved chipping hammer, having a head with a toothed edge constructed and arranged so as to facilitate cleaning a weld or the like working surface.

Another object of this invention is to provide an improved chipping hammer for use by a welder having a handle with a head at one end, such head having a concave radiused end for better scaling or cleaning a curved weld surface, as for example, a pipe weld.

Yet another object of this invention is to provide a chipping hammer having a head with a concave-radiused, toothed end for facilitating cleaning the crown and edges of a weld. Other advantages of the present invention will become more apparent from the description which follows.

BRIEF DESCRIPTION OF THE DRAWING

There is shown in the drawing one presently preferred embodiment of the invention, wherein like numerals designate the corresponding parts in the various views.

FIG. 1 is a side perspective view of the chipping hammer of the present invention;

FIG. 2 is a side elevation of the head of the present invention;

FIG. 3 is a front elevation view of the head of the present invention; and

FIG. 4 is a bottom view of the head of the present invention.

DETAILED DESCRIPTION OF THE INVENTION

Referring to the drawing, the chipping hammer 10 of the present invention includes an elongated handle 12 having a grip portion 14 and a head 16 affixed at an end of handle 12. The grip portion 14 may be formed integrally from the material of the handle 12, for example, wood, or the grip portion 14 may comprise leather, plastic or the like wrapped or otherwise affixed to the handle 12.

The head 16 comprises a body portion 18 having an opening 20 therein receiving the end of the handle 12, a hammer head portion 22 at one end and a chisel-type blade 24 at the other end. The opening 20 may be tapered for receiving the complementary tapered end of handle 12. If the force fit is insufficient to maintain the head 18 on the handle 12, a suitable fastening means, for example, a wedge, can be employed to retain the head 16 on handle 12. Head 16 is preferably fabricated from metal having good shock and impact resistant properties, for example, SAE 6150 alloy steel or SAE S-2 tool steel. The SAE 6150 and SAE S-2 steels also can be readily cast or forged. Further, they can be heat treated and tempered easily to provide desirable strength and shock resistance to the head.

The chisel-type blade 24 is unique by virtue of being toothed and constructed and arranged so as to facilitate chipping and cleaning of a weld or the like surface. The chipping hammer 10 will clean slag or similar deposits from welds by the welder or it can be used in oxyacetylene cutting to deburr or remove splatter around a cut in the metal. The tips or extremities of teeth 26 are arranged along a concave curved line, preferably with the rear tooth **26*b* projecting further from the blade 24 than the front tooth 26*a*. An advantage of this arrangement is that the hand of the user can be elevated above the surface of the weld to be cleaned. The user's hand is away from a potentially hot surface that could burn him or from a rough surface that might cut his hand. By holding the hammer, with the teeth 26 of chipping blade 24 on the weld and the axis of the handle horizontal or slightly elevated and sweeping head 16 along the weld, a superior job of cleaning weld splatter from the surface being welded can be accomplished. Further, as best seen in FIG. 2, the axes of the teeth 26 are parallel to one another and to the vertical axis of the head 16. The teeth 26 lie along a concave curve having a radius in one form of the invention of 7.3 inches. The radius may lie in the center line of the head 18 or the radius can be offset therefrom. In the presently preferred form shown in FIG. 2, the radius of the concave curve of the teeth 26*b* is offset from the center line through the head 18 to provide the relationship of the front tooth and rear tooth best shown in FIG. 2. The rear tooth 26*b* projects about 0.150 inch beyond the front tooth 26*a*, considering the centerline or axis of the handle 12** as the reference line.

As viewed from the front (FIG. 3), the teeth 26 have a chisel-like configuration and converge to a blunt apex. In one presently preferred form of the invention the blade 16 is about 1.65 inches wide and is formed with eleven teeth 26, each extending about 0.2 inch from the blade and located on centers 0.15 inch apart. The head 16 and handle 12 weigh about one pound and is of balanced design to facilitate use. The hammer head portion 22 and the chipping blade 24 each extend the same distance from the centerline of the handle 12. In the embodiment discussed, the distance from the centerline of handle 12 to the top of hammer head portion 22 and from the centerline of handle 12 to the end of tooth.

The points or apexes of the teeth 26 are blunt—not knife edges—so as to permit the user to chip the slag formed on a weld and not leave significant surface striations which might lead to cracks forming in the weld. The edges of the teeth 26 should be relatively square and thus, sharp so that when the chipping hammer is used in a longitudinal raking action, the edges would act as a cutting tool in breaking up the adhesive qualities of slag formed in the weld pass. The tip or point of each tooth should be slightly blunted or rounded so as to be sharp enough to break up the slag as deposited, for example, by an Exx 14, 16 or 18 coated rod in multi-pass welding, where a striking action of the chipping hammer must be used, but still blunt enough to prevent striations when cleaning slag from a finished pass weld employing a raking action. The teeth 26 are formed from surfaces transverse to the plane of the blade 24, which converge toward the edges of the teeth (FIG. 4).

The chipping hammer 10 requires no unusual manufacturing operations and thus, costs about the same to make as prior chipping hammers which do not have the advantages of the present design. In use, the hammer head portion 22 is used in conventional manner to strike and break large slag accumulations. Smaller slag accumulations can be broken or chipped by the chipping blade 24 and then the handle 12 can be moved with a longitudinal raking action, whereby the edges of the teeth 26 can scrape and clean the weld bead or weld surface. For a butt weld, the chipping hammer 10 could be oriented obliquely to the axis of the weld for a raking cleaning action. It has been found that the cleaning action is enhanced when the axis of the handle 12 is at an oblique angle to the axis of the weld, for during this mode of use, the edges of the teeth 26 can act as cutting tools.

The present chipping hammer 10 comprises a combination tool, with a hammer head portion at one end of the head that can be employed in the usual manner and the novel chipping blade of this invention at the other end of the head. Often use of the tool of this invention will mean one less tool to carry by the user, for example, a separate hammer. This is important in construction trades when the user may be working on ladders or scaffolding or structural steel, or like inaccessible or hard to work on places.

The embodiments of the invention in which an exclusive property or privilege is claimed are defined as follows:

1. A chipping hammer for cleaning welds and the like comprising an elongated handle, a head fixed to an end of the handle, said head having a hammer head portion on one end and a chipping blade projecting from the other end, said chipping blade having a plurality of teeth formed on the end thereof, said teeth being formed with surfaces transverse and square to the plane of the head and converging toward the tip of the tooth to form a blunt tip, the edges of each tooth being sharp, the axis of said handle lying in the plane of said chipping blade for facilitating use of the chipping hammer in scraping chipping and cleaning welds.

2. A chipping hammer for cleaning welds and the like comprising an elongated handle, a head fixed to an end of the handle, said head having a hammer head portion on one end and a chipping blade projecting from the other end, said chipping blade having a plurality of teeth formed on the end thereof, the axis of said handle lying in the plane of said chipping blade for facilitating use of the chipping hammer in scraping, chipping and cleaning welds, the ends of the teeth of the chipping blade being non-linear and lying along a concave curve.

3. A chipping hammer as in claim 2, wherein the rear tooth projects outwardly further from the head than does the front tooth.

4. A chipping hammer as in claim 3 wherein the head is fixed in perpendicular relation to the axis of the elongated handle.

5. A chipping hammer as in claim 4 wherein the centerline for each tooth is parallel to the vertical centerline of the head.

6. A chipping hammer as in claim 2 wherein the teeth are formed with surfaces transverse to the plane of the head and converging toward the edges of the teeth.

7. A chipping hammer for cleaning welds and the like comprising an elongated handle, a head fixed to and end of the handle, said head having a hammer head portion on one end and a chipping blade projecting from the other end, said chipping blade having a plurality of teeth formed on the end thereof, the axis of said handle lying in the plane of said chipping blade for facilitating use of the chipping hammer in scraping, chipping and cleaning welds, and the ends of the chipping blade lying along a curve the radius of which is offset from the vertical centerline of the head.

* * * * *